US012702258B2

(12) United States Patent
Qiu et al.

(10) Patent No.: US 12,702,258 B2
(45) Date of Patent: Aug. 11, 2026

(54) FLOOR BRUSH ASSEMBLY FOR VACUUM CLEANER AND VACUUM CLEANER

(71) Applicants: JIANGSU MIDEA CLEANING APPLIANCES CO., LTD., Suzhou (CN); MIDEA GROUP CO., LTD., Foshan (CN)

(72) Inventors: Zhihong Qiu, Suzhou (CN); Jianming Huang, Suzhou (CN); Yakun Wang, Suzhou (CN); Min Wei, Suzhou (CN); Fuping Cheng, Suzhou (CN)

(73) Assignees: JIANGSU MIDEA CLEANING APPLIANCES CO., LTD., Suzhou (CN); MIDEA GROUP CO., LTD., Foshan (CN)

( * ) Notice: Subject to any disclaimer, the term of this patent is extended or adjusted under 35 U.S.C. 154(b) by 396 days.

(21) Appl. No.: 18/560,077

(22) PCT Filed: Jan. 24, 2022

(86) PCT No.: PCT/CN2022/073518
§ 371 (c)(1),
(2) Date: Nov. 9, 2023

(87) PCT Pub. No.: WO2022/237235
PCT Pub. Date: Nov. 17, 2022

(65) Prior Publication Data

US 2024/0237862 A1 Jul. 18, 2024

(30) Foreign Application Priority Data

May 10, 2021 (CN) ..... 202110507798.9

(51) Int. Cl.
*A47L 9/04* (2006.01)

(52) U.S. Cl.
CPC ..... *A47L 9/0411* (2013.01); *A47L 9/0433* (2013.01); *A47L 9/0444* (2013.01); *A47L 9/0455* (2013.01); *A47L 9/0477* (2013.01)

(58) Field of Classification Search
CPC .... A47L 9/0411; A47L 9/0433; A47L 9/0444; A47L 9/0455; A47L 9/0477
See application file for complete search history.

(56) References Cited

U.S. PATENT DOCUMENTS 6,539,575 B1 * 4/2003 Cohen ..... A46B 13/001 15/364
2004/0074039 A1 4/2004 Kim
(Continued)

FOREIGN PATENT DOCUMENTS

CN 106798531 A 6/2017
CN 110236450 A 9/2019
(Continued)

OTHER PUBLICATIONS

The first office action received in the counterpart CA application 3,218,353, dated Mar. 17, 2025, 4 pages.
(Continued)

*Primary Examiner* — Andrew J Marien
(74) *Attorney, Agent, or Firm* — K&L Gates LLP

(57) ABSTRACT

Provided is a floor brush assembly for a vacuum cleaner. The floor brush assembly includes a roller brush component and a driving mechanism. A roller brush body of the roller brush component is rotatably mounted in a sleeve. The roller brush body is provided with bristles arranged in an elongated shape to form a bristle portion. The sleeve of the roller brush component has an avoidance opening of an elongated shape, and the bristle portion and the avoidance opening are arranged to directly face towards each other in a radial direction of the roller brush body. A first driving member of the driving mechanism is configured to drive the roller brush
(Continued)

body to rotate, and a second driving member is configured to drive the sleeve to rotate. The first driving member and the second driving member are eccentrically arranged to allow the bristle portion to be selectively extended or retracted through the avoidance opening.

18 Claims, 7 Drawing Sheets

(56) References Cited

U.S. PATENT DOCUMENTS

| | | | | |
|---|---|---|---|---|
| 2013/0192021 | A1* | 8/2013 | Eriksson | A47L 9/0494 15/383 |
| 2014/0000054 | A1 | 1/2014 | Liffers et al. | |
| 2019/0307302 | A1* | 10/2019 | Zheng | A47L 9/0477 |
| 2020/0245831 | A1* | 8/2020 | Peng | A47L 9/242 |
| 2021/0068600 | A1* | 3/2021 | Xing | A46B 9/005 |
| 2021/0186291 | A1* | 6/2021 | Nguyen | A47L 9/325 |
| 2023/0051802 | A1* | 2/2023 | Xu | A46B 17/06 |

FOREIGN PATENT DOCUMENTS

| | | | |
|---|---|---|---|
| CN | 110477803 | A | 11/2019 |
| CN | 110897551 | A | 3/2020 |
| CN | 211704445 | U | 10/2020 |
| CN | 211961925 | U | 11/2020 |
| CN | 112674642 | A | 4/2021 |
| CN | 213588169 | U | 7/2021 |
| CN | 113229743 | A | 8/2021 |
| CN | 113229744 | A | 8/2021 |
| CN | 113229745 | A | 8/2021 |
| CN | 113229746 | A | 8/2021 |
| CN | 215078006 | U | 12/2021 |
| JP | S5953120 | A | 3/1984 |
| JP | S62130123 | A | 6/1987 |
| JP | 2005028099 | A | 2/2005 |
| JP | 2010284528 | A | 12/2010 |

OTHER PUBLICATIONS

The Decision to Grant a Patent received in the counterpart JP application 2023-569655, dated Mar. 11, 2025, 5 pages with English translation.

International Search Report received in PCT/CN2022/073518; mailed Apr. 25, 2022.

Extended European search report received in EP Application No. 22806212.1; mailed Oct. 16, 2024.

First OA received in JP Application No. 2023-569655; mailed Sep. 10, 2024.

First OA received in CN Application No. 202110507798.9; mailed Feb. 25, 2022.

The second office action received in the counterpart CA application 3,218,353, dated Mar. 5, 2026, 5 pages.

* cited by examiner

FLOOR BRUSH ASSEMBLY FOR VACUUM CLEANER AND VACUUM CLEANER

CROSS-REFERENCES TO RELATED APPLICATIONS

The present disclosure is a national phase application of International Application No. PCT/CN2022/073518, filed on Jan. 24, 2022, which claims priority to Chinese Patent Application No. 202110507798.9 filed on May 10, 2021, the entire disclosure of which is incorporated herein by reference.

FIELD

The present disclosure relates to the field of household appliance manufacturing, and more particularly, to a floor brush assembly for a vacuum cleaner and a vacuum cleaner having the floor brush assembly.

BACKGROUND

An eccentric sleeve-type anti-hair-winding roller brush is an improvement on a conventional roller brush by being additionally provided with a sleeve. An overall structure of the roller brush is significantly changed, which greatly affects basic performance of a vacuum cleaner. Compared with a vacuum cleaner using a general roller brush, the eccentric sleeve-type anti-hair-winding roller brush has a significant reduction in dust removal efficiency and is prone to dust accumulation. In the related art, holes is formed at a surface of the sleeve and passes through the sleeve in a wall thickness direction of the sleeve. Each cluster of bristles has one-to-one correspondence to a corresponding hole, making alignment difficult and installation challenging. In one embodiment, deformation of the bristles is restricted when the bristles clean the ground, resulting in poor cleaning capability. As a result, improvement is required.

SUMMARY

The present disclosure aims to at least solve one of the above problems in the existing related art. To this end, the present disclosure proposes a floor brush assembly for a vacuum cleaner. In the floor brush assembly, an avoidance opening of an elongated shape is formed at a surface of a sleeve and corresponds to a bristle portion, which reduces an influence of the sleeve on deformation of the bristle portion, and improves a dust removal capability.

A floor brush assembly for a vacuum cleaner according to an embodiment of the present disclosure includes a roller brush component and a driving mechanism. The roller brush component includes a sleeve and a roller brush body rotatably mounted in the sleeve. The roller brush body is provided with bristles arranged in an elongated shape to form a bristle portion. The sleeve has an avoidance opening of an elongated shape, and the bristle portion and the avoidance opening are arranged directly to face towards each other in a radial direction of the roller brush body. The driving mechanism includes a first driving member and a second driving member. The first driving member is configured to drive the roller brush body to rotate, and the second driving member is configured to drive the sleeve to rotate. The first driving member and the second driving member are eccentrically arranged to allow the bristle portion to be selectively extended out of or retracted into the avoidance opening.

In the floor brush assembly for the vacuum cleaner according to an embodiment of the present disclosure, the first driving member and the second driving member are eccentrically arranged to allow the bristles to be selectively extended out of or retracted into the sleeve, which can address a problem in which the roller brush body becomes entangled in elongated objects such as hair and threads. In one embodiment, the bristle portion and the avoidance opening are both of an elongated shape and arranged to directly face towards each other in the radial direction of the roller brush body. Therefore, when the bristle portion is extended out of the sleeve through the avoidance opening, an influence of an inner wall of the avoidance opening on deformation of the bristles is reduced, which provides the bristles with more extended space and enhances a dust removal capability of the bristles. Meanwhile, the bristle portion and the avoidance opening of the elongated shape have a low assembly difficulty, which facilitates an improvement in mounting efficiency of the roller brush body and the sleeve.

In the floor brush assembly for the vacuum cleaner according to an embodiment of the present disclosure, the avoidance opening extends spirally in a circumferential direction of the sleeve, and the bristle portion is constructed to follow a shape of the avoidance opening.

In the floor brush assembly for the vacuum cleaner according to an embodiment of the present disclosure, bristle portions is provided and arranged at intervals in a circumferential direction of the roller brush body. Avoidance openings is provided and arranged at intervals in the circumferential direction of the sleeve. Bristle portions and avoidance openings are in one-to-one correspondence.

In the floor brush assembly for the vacuum cleaner according to an embodiment of the present disclosure, a reinforcement rib is provided at the avoidance opening and divides the avoidance opening into sub-openings in an axial direction of the sleeve. The bristle portion includes sub-bristle groups arranged at intervals in an axial direction of the roller brush body. Sub-openings and sub-bristle groups are in one-to-one correspondence.

In the floor brush assembly for the vacuum cleaner according to an embodiment of the present disclosure, a flexible dust removal member is provided between an outer peripheral wall of the roller brush body and an inner peripheral wall of the sleeve.

In the floor brush assembly for the vacuum cleaner according to an embodiment of the present disclosure, the flexible dust removal member is integrated at the outer peripheral wall of the roller brush body. A radial outer side of the flexible dust removal member elastically abuts with the inner peripheral wall of the sleeve.

In the floor brush assembly for the vacuum cleaner according to an embodiment of the present disclosure, flexible dust removal members is provided. Bristle portions is provided. Flexible dust removal members and bristle portions are alternatively arranged at the outer peripheral wall of the roller brush body.

In the floor brush assembly for the vacuum cleaner according to an embodiment of the present disclosure, the driving mechanism further includes a power source, a transmission shaft, a linkage structure, and a driving wheel connected to the power source. The driving wheel is connected to the first driving member through the transmission shaft and connected to the second driving member through the linkage structure.

In the floor brush assembly for the vacuum cleaner according to an embodiment of the present disclosure, the driving wheel has a transmission hole. The transmission shaft passes through the transmission hole and is relatively fixed to the driving wheel circumferentially. The second driving member has an avoidance hole. The transmission shaft passes through the avoidance hole to be connected to the first driving member. A rotation axis of the driving wheel is coincident with an axis of the transmission shaft, an axis of the avoidance hole is coincident with a rotation axis of the second driving member, and the axis of the transmission shaft is offset from the axis of the avoidance hole.

In the floor brush assembly for the vacuum cleaner according to an embodiment of the present disclosure, the driving mechanism further includes a bearing support block rotatably supported at a second transmission block. The bearing support block has an eccentric hole. An axis of the eccentric hole is offset from the axis of the avoidance hole, and the transmission shaft is rotatably supported at the eccentric hole.

The present disclosure further proposes a vacuum cleaner. The vacuum cleaner according to an embodiment of the present disclosure includes the floor brush assembly according to any one of the above embodiments.

Compared with the related art, the vacuum cleaner has the same advantages as the floor brush assembly, and details thereof will be omitted herein.

Additional embodiments of the present disclosure will be set forth, in part, from the following description, and in part will become apparent from the following description, or may be learned by practice of the present disclosure.

BRIEF DESCRIPTION OF THE DRAWINGS

The above and/or additional embodiments of the present disclosure will become apparent and readily understood from the following description of embodiments in conjunction with the accompanying drawings, in which.

Figure 1:
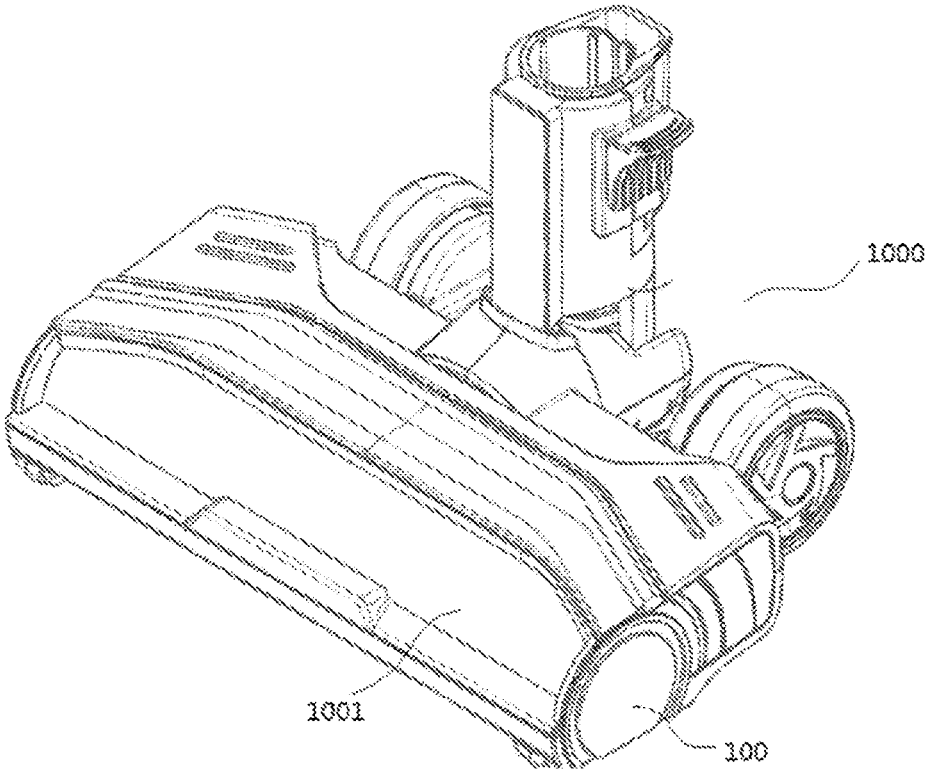
FIG. 1 is a schematic structural view of a vacuum cleaner according to an embodiment of the present disclosure.

REFERENCE NUMERALS vacuum cleaner 1000, floor brush assembly 100, roller brush component 1, roller brush body 11, first driven tooth 111, bristle 112, brush body structure 113, driven shaft 114, flexible dust removal member 115, bristle portion 116, sleeve 12, second driven tooth 121, avoidance opening 122, sub-opening 123, reinforcement rib 124, driving mechanism 2, transmission assembly 21, driving wheel 22, first transmission hole 221, second transmission hole 222, first driving member 23, first driving tooth 231, second driving member 24, transmission portion 241, support connection portion 242, second driving tooth 243, avoidance hole 244, third transmission hole 245, transmission shaft 25, linkage structure 26, bearing support block 27, eccentric hole 271, driving casing 28, motor support 281, driving side end cover 282, power source 29, drive wheel 291, belt 3, bearing 4, driven side end cover 5, housing 1001, roller brush upper cover 1002, bottom plate 1003.

DETAILED DESCRIPTION OF THE DISCLOSURE

The embodiments of the present disclosure will be described in detail below with reference to examples thereof as illustrated in the accompanying drawings, throughout which same or similar elements, or elements having same or similar functions, are denoted by same or similar reference numerals. The embodiments described below with reference to the accompanying drawings are illustrative only, and are intended to explain, rather than limiting the present disclosure.

Various embodiments or examples for implementing different structures of the present disclosure are provided below. In order to simplify the description of the present disclosure, components, and configurations of specific examples are described below. These specific examples are merely for the purpose of illustration, rather than limiting the present disclosure. Further, the same reference numerals and/or reference letters may appear in different examples of the present disclosure for the purpose of simplicity and clarity, instead of indicating a relationship between different embodiments and/or the discussed configurations. In addition, the present disclosure provides examples of various specific processes and materials.

A floor brush assembly 100 according to an embodiment of the present disclosure will be described below with reference to FIG. 1 to FIG. 8. The floor brush assembly 100 is adapted for a vacuum cleaner. A first driving member 23 is driven by a part of a driving force output from a power source 29 of the floor brush assembly 100 at a driving wheel 22 through a transmission shaft 25, to drive a roller brush body 11 to rotate. Further, a second driving member 24 is driven by another part of the driving force through a linkage structure 26, to drive a sleeve 12 to rotate. In this way, the roller brush body 11 and the sleeve 12 can be driven independently. In one embodiment, during this transmission, transmission of power does not need to be performed by using two belt pulleys through a gear engagement structure as in traditional technology. Therefore, a reduction in requirements for engagement precision among various components is facilitated. In one embodiment, excessive wear of a gear transmission structure can be avoided. It is especially less prone to assembly misalignment, to enhance practicability of the floor brush assembly 100.

Figure 2:
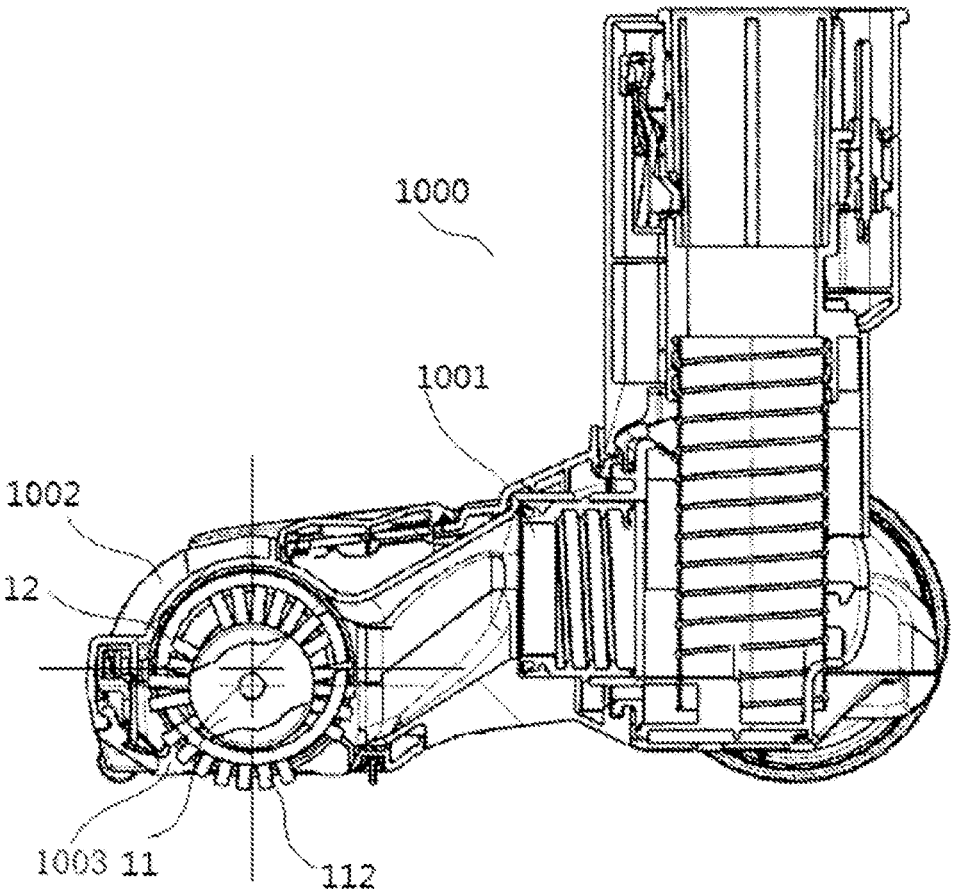
FIG. 2 is a side view of a vacuum cleaner according to an embodiment of the present disclosure.

It should be noted that the floor brush assembly 100 according to some embodiments of the present disclosure may be integrally mounted in a housing 1001 of a vacuum cleaner 1000. FIG. 1 illustrates a schematic structural view of a vacuum cleaner 1000 according to an embodiment of the present disclosure. As illustrated in FIG. 1, the floor brush assembly 100 is mounted at a bottom of the vacuum cleaner 1000. As illustrated in FIG. 2, the floor brush assembly 100 is located at a bottom of the vacuum cleaner 1000 at a front side of the vacuum cleaner 1000. As illustrated in FIG. 2, a bottom of the housing 1001 of the vacuum cleaner 1000 at a front side of the housing 1001 is open to form a cleaning opening in a region of the bottom of the housing 1001 at the front side of the housing 1001. Bristles 112 of a roller brush component 1 of the floor brush assembly 100 may extend from the cleaning opening and can clean a surface to be cleaned. For example, the surface to be cleaned may be the ground. In this way, the bristles 112 can sweep debris, hair, or the like on the ground, and cooperate with a dust collector assembly of the vacuum cleaner 1000 to suck and collect the debris and hair, to achieve an effect of cleaning the ground.

Further, during mounting, as illustrated in FIG. 2, the vacuum cleaner 100 is provided with a roller brush upper cover 1002 at a top of a front part of the vacuum cleaner 1000. A bottom plate 1003 is provided at a bottom of the front part of the vacuum cleaner 1000. The roller brush upper cover 1002 is spaced apart from the bottom plate 1003 in an up-down direction to define a mounting space between the roller brush upper cover 1002 and the bottom plate 1003. In addition, the bottom plate 1003 has a cleaning opening. The floor brush assembly 100 is mounted in the mounting space. Further, the bristles 112 pass through the cleaning opening at the bottom plate 1003 to clean the ground.

Figure 3:
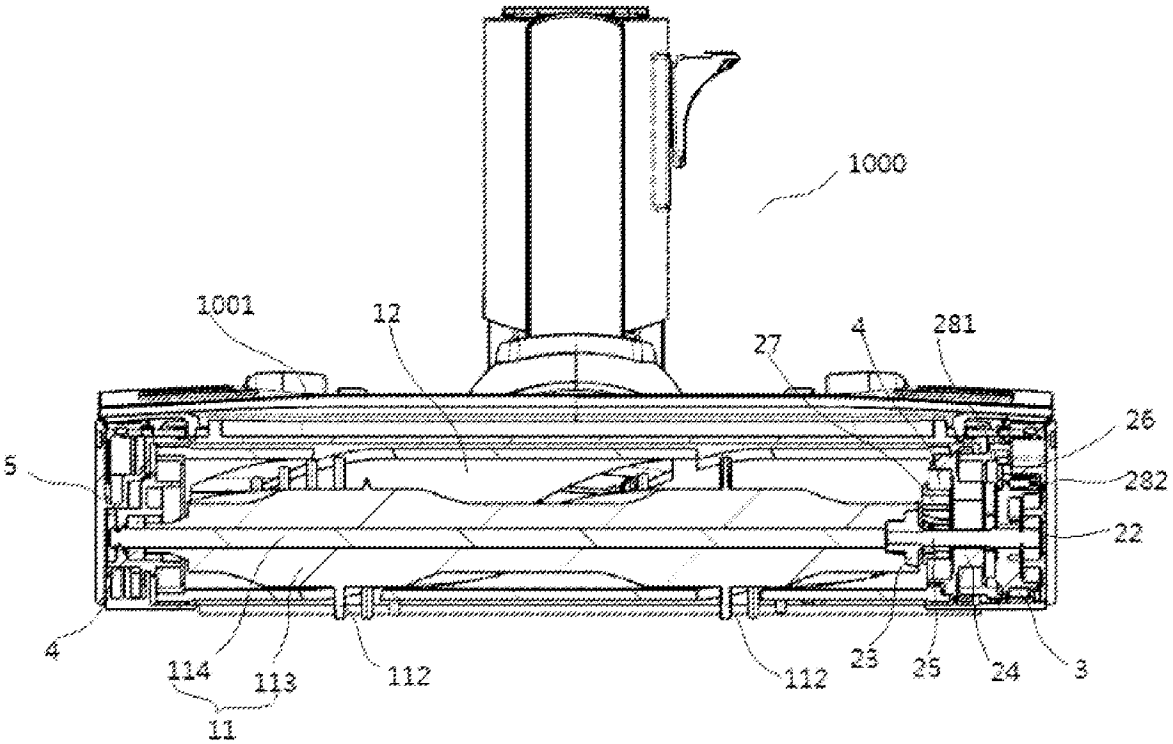
FIG. 3 is a schematic cross-sectional view of a vacuum cleaner at a floor brush assembly according to an embodiment of the present disclosure.
Figure 4:
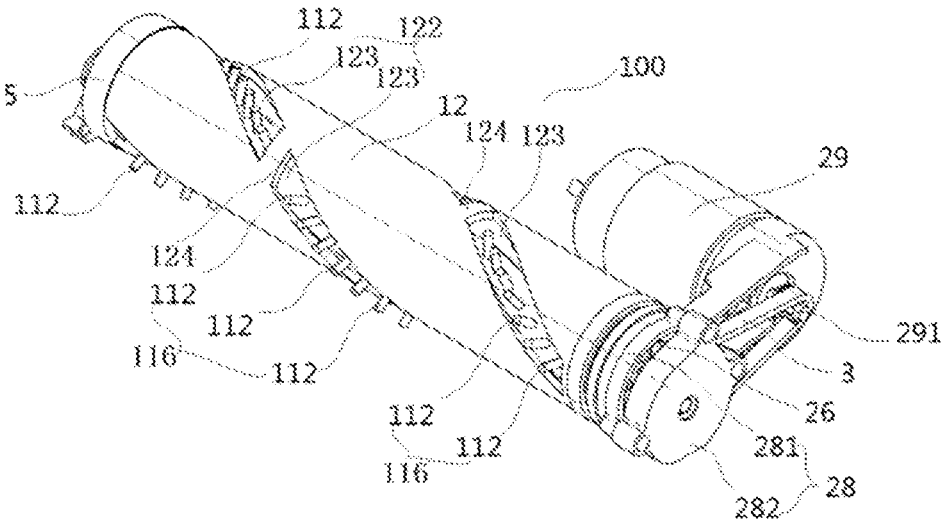
FIG. 4 is a schematic structural view of a floor brush assembly according to an embodiment of the present disclosure.

As illustrated in FIG. 3 and FIG. 4, the floor brush assembly 100 according to an embodiment of the present disclosure includes a roller brush component 1 and a driving mechanism 2. The driving mechanism 2 and the roller brush component 1 are both mounted in the housing 1001. Further, the driving mechanism 2 is fixedly connected to the housing 1001, and the roller brush component 1 is rotatably supported in the housing 1001 to be connected to an output end of the driving mechanism 2. As a result, a driving force at the driving mechanism 2 can be output to the roller brush component 1. Therefore, the roller brush component 1 can be driven by the driving mechanism 2 to rotate relative to the housing 1001. In this way, during rotation of the roller brush component 1, the bristles 112 of the roller brush component 1 can be extended from the cleaning opening for cleaning the surface to be cleaned.

Figure 7:
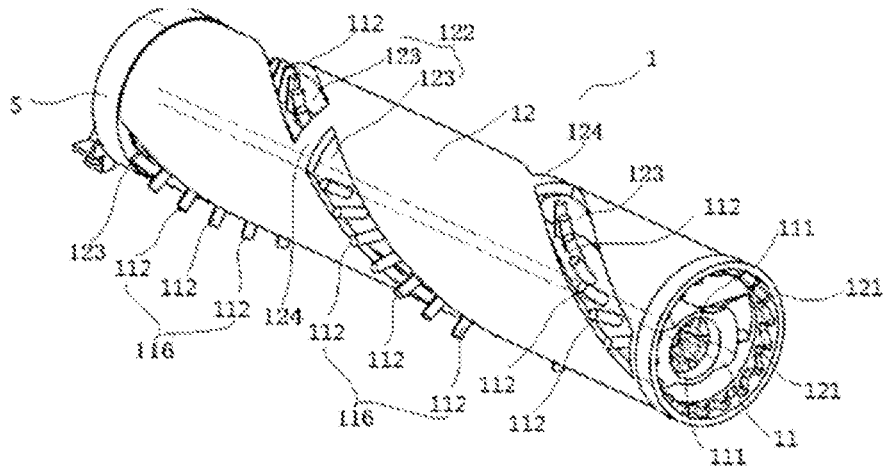
FIG. 7 is a schematic structural view of a roller brush component of a driving mechanism of a floor brush assembly according to an embodiment of the present disclosure.

As illustrated in FIG. 3, the roller brush component 1 includes a sleeve 12 and a roller brush body 11. A left end of the sleeve 12 is rotatably supported in the housing 1001 of the vacuum cleaner 1000, and a right end of the sleeve 12 (the right end illustrated in FIG. 3 is only used for ease of description and does not limit actual mounting) is mounted to the output end of the driving mechanism 2, enabling the sleeve 12 to be driven by the driving mechanism 2 from the right end of the sleeve 12 to rotate relative to the housing 1001. The sleeve 12 has an internal mounting space, and the roller brush body 11 is rotatably mounted in the sleeve 12. In addition, as illustrated in FIG. 3, the roller brush body 11 includes an external brush body structure 113 and a driven shaft 114 integrated inside the brush body structure 113. Further, the brush body structure 113 and the driven shaft 114 are integrated into one piece to rotate together relative to the sleeve 12. As illustrated in FIG. 3, a left end of the driven shaft 114 is rotatably supported at the left end of the sleeve 12 through a bearing 4. As illustrated in FIG. 7, a driven side end cover 5 is provided at the left end of the sleeve 12, and the left end of the driven shaft 114 is supported at the driven side end cover 5 through the bearing 4. Further, a right end of the brush body structure 113 is in power connection with the driving mechanism 2. Therefore, the roller brush body 11 can be driven by the driving mechanism 2 to rotate.

Figure 5:
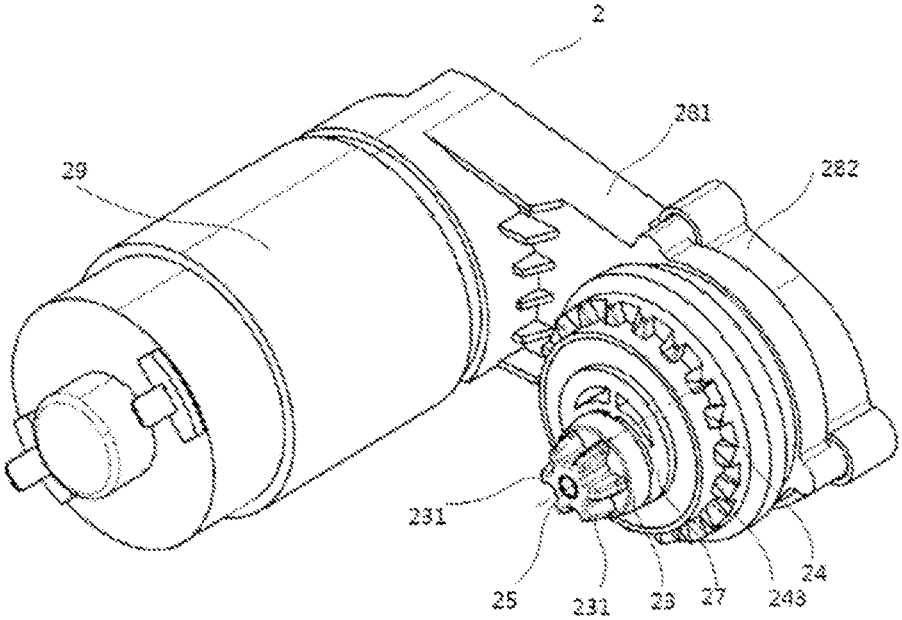
FIG. 5 is a schematic structural view of a driving mechanism of a floor brush assembly according to an embodiment of the present disclosure.

The driving mechanism 2 includes a power source 29 and a transmission assembly 21. The transmission assembly 21 includes a first driving member 23 and a second driving member 24. As illustrated in FIG. 5, the first driving member 23 is constructed as a circular block, allowing the first driving member 23 to have its own rotation axis and to rotate around its own rotation axis. The second driving member 24 is constructed as a circular block, allowing the second driving member 24 to have its own rotation axis and to rotate around its own rotation axis. The first driving member 23 is configured to drive the roller brush body 11 to rotate, and as illustrated in FIG. 3, the first driving member 23 is in direct contact engagement with a right end of the roller brush body 11 to transfer a force from the first driving member 23 to the roller brush body 11, driving the roller brush body 11 to rotate. The second driving member 24 is configured to drive the sleeve 12 to rotate, and the second driving member 24 is in direct contact engagement with a right end of the sleeve 12 to transfer a force from the second driving member 24 to the sleeve 12, driving the sleeve 12 to rotate. That is, a part of a driving force from the drive motor is output to the first driving member 23 to allow the roller brush body 11 to rotate in the sleeve 12. In addition, another part of the driving force is output to the second driving member 24 to allow the sleeve 12 to rotate relative to the housing 1001.

As illustrated in FIG. 4 and FIG. 7, the roller brush body 11 is provided with bristles 112. The bristles 112 are arranged at an outer peripheral wall of the roller brush body 11. The bristles 112 protrude and extend from the outer peripheral wall of the roller brush body 11 radially. An avoidance opening 122 penetrates an outer peripheral wall of the sleeve 12 in a radial direction of the sleeve 12. The bristles 112 can be extended from the avoidance opening 122. The first driving member 23 and the second driving member 24 are eccentrically arranged to allow the bristles 112 to be selectively extended out of or retracted into the sleeve 12. That is, when the roller brush body 11 is driven by the first driving member 23 to rotate and the sleeve 12 is driven by the second driving member 24, an axis of the roller brush body 11 is offset from an axis of the sleeve 12. It should be noted that, as illustrated in FIG. 3, a rotation axis of the roller brush body 11 is lower than a rotation axis of the sleeve 12, and the bristles 112 are provided at each of different positions on the outer peripheral wall of the roller brush body 11. Meanwhile, different avoidance openings 122 is formed at the outer peripheral wall of the sleeve 12. In this way, when the bristles 112 at the outer peripheral wall of the roller brush body 11 and the avoidance openings 122 of the sleeve 12 are both located in a lower region, and the bristles 112 at the lower region can be extended downwards from the avoidance opening 122 for cleaning the surface to be cleaned. In one embodiment, when the bristles 112 at the outer peripheral wall of the roller brush body 11 and the avoidance openings 122 of the sleeve 12 are both located in an upper region, the bristles 112 at the upper region can be retracted into the sleeve 12 through the avoidance opening 122.

It can be understood that when the bristles 112 is extended out of the sleeve 12, the bristles 112 can clean the ground. In addition, when the bristles 112 are retracted into the sleeve 12, debris at the bristles 112 can be separated from the bristles 112 under an action of an opening wall of the avoidance opening 122. In this way, excessive debris entangled at the bristles 112 are prevented from affecting normal rotation of the roller brush body 11. Therefore, a reduction in cleaning difficulty of the bristles 112 is facilitated, which obviates the need for a user for manual cleaning and improves the practicability. In addition, a problem of winding the roller brush body 11 by elongated objects like hair and threads can be solved.

That is, during operation of the floor brush assembly 100 according to embodiments of the present disclosure, when the bristles 112 is extend out of the avoidance opening 122 to be in contact with the surface to be cleaned, the bristles 112 would be deformed, and the deformed bristles 112 are easily in contact with an inner peripheral wall of the avoidance opening 122, limiting a degree of deformation of the bristles 112. In the present disclosure, the bristles 112 are constructed to be arranged in an elongated shape to form the bristle portion 116. In one embodiment, the avoidance opening 122 is constructed as an elongated shape and is arranged at the outer peripheral wall of the sleeve 12. In this way, the avoidance opening 122 is constructed as an elongated opening and has a great opening width. In one embodiment, the bristle portion 116 and the avoidance opening 122 are arranged to directly face towards each other in a radial direction of the roller brush body 11.

Figure 6:
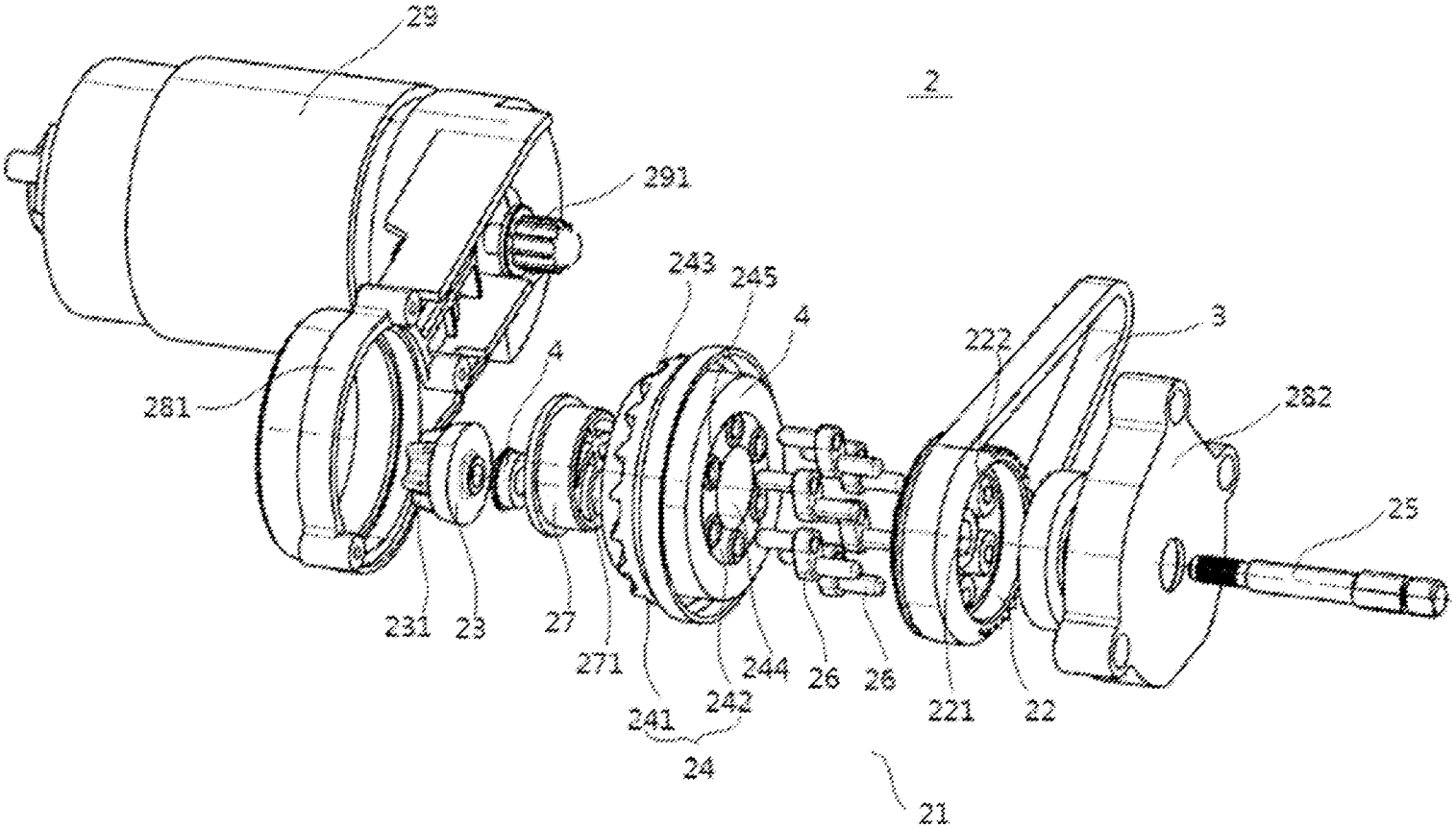
FIG. 6 is an exploded view of a driving mechanism of a floor brush assembly according to an embodiment of the present disclosure.

Here, as illustrated in FIG. 6 and FIG. 7, many clusters of bristles 112 are arranged adjacent to each other in an elongated shape, and are constructed as an elongated extending bristle portion 116. That is, when the bristle portion 116 is extended from the avoidance opening 122, many clusters of bristles 112 are constructed as the bristle portion 116 and are extended or retracted through the avoidance opening 122 as a whole. In this way, compared with an arrangement in which each cluster of bristles 112 is independently provided with a small opening for avoidance, each cluster of bristles 112 has a great deformation space. Therefore, it is advantageous to increase a spacing between the bristles 112 and an inner wall of the avoidance opening 122 and the deformation space of the bristles 112. In this way, after the bristles 112 are extended from the avoidance opening 122, a large deformation amount is generated to clean the ground, which reduces restrictions of the inner wall of the avoidance opening 122 on the deformation of the bristles 112, enabling the bristles 112 to have a great extended space. In addition, a dust removal capability of the bristles 112 is improved.

Meanwhile, it can be understood that both the bristle portion 116 and the avoidance opening 122 are of the elongated shape. Compared with the design in which each cluster of bristles 112 is independently provided with a small opening, the number of the avoidance openings 122 is greatly reduced. In one embodiment, when the roller brush body 11 is mounted and engaged with the sleeve 12, many clusters of bristle 112 may be constructed as the bristle portion 116 as a whole to be positioned relative to the avoidance opening 122. That is, each cluster of bristles 112 is not required to be accurately positioned, which greatly lowers accuracy at which the bristle portion 116 is mounted and engaged with the avoidance opening 122. Therefore, mounting difficulty of the roller brush body 11 and the sleeve 12 is lowered. In one embodiment, it is beneficial to enhance mounting efficiency and save required time costs during mounting.

In the floor brush assembly 100 according to an embodiment of the present disclosure, the first driving member 23 and the second driving member 24 are eccentrically arranged to allow the bristles 112 to be selectively extended out of or retracted into the sleeve 12, which can address a problem in which the roller brush body 11 becomes entangled in elongated objects such as hair and threads. In one embodiment, the bristle portion 116 and the avoidance opening 122 are both of the elongated shape and arranged to directly face towards each other in the radial direction of the roller brush body 11. Therefore, when the bristle portion 116 is extended out of the sleeve 12 through the avoidance opening 122, an influence of the inner wall of the avoidance opening 122 on the deformation of the bristles 112 is reduced, which provides the bristles 112 with a large extended space and enhances the dust removal capability of the bristles 112. Meanwhile, the bristle portion 116 and the avoidance opening 122 of the elongated shape have low assembly difficulty, which improves mounting efficiency of the roller brush body 11 and the sleeve 12.

In some embodiments, as illustrated in FIG. 4, the avoidance opening 122 spirally extends from one end of the sleeve 12 in a circumferential direction of the sleeve 12 to another end of the sleeve 12, and the bristle portion 116 is constructed to follow a shape of the avoidance opening 122 to be spirally arranged at an outer wall of the roller brush body 11. In this way, the roller brush body 11 is provided with the bristle portion 116 over the length of the roller brush body 11. When the roller brush body 11 continuously rotates, dead-corner-free cleaning may be implemented on the ground below the floor brush assembly 100. In one embodiment, during rotation, the bristles 112 at a bottom of the floor brush assembly 100 are always extended from the avoidance opening 122. In this way, the ground is continuously cleaned, and a case of idling is avoided, making a cleaning process more stable and enabling an operator to have better operation hand feeling.

During mounting of the roller brush body 11, an end of the roller brush body 11 is inserted into a cavity of the sleeve 12, and spirally rotates relative to the sleeve 12, allowing the roller brush body 11 be loaded into the cavity of the sleeve 12. Therefore, convenient mounting of the roller brush body 11 can be realized. In one embodiment, a relative circumferential position of the avoidance opening 122 relative to the bristle portion 116 may be adjusted by rotating the roller brush body 11 relative to the sleeve 12, which enables the bristle portion 116 to be arranged to directly face towards the avoidance opening 122, improving mounting precision of the roller brush body 11.

In some embodiments, bristle portions 116 is provided and arranged at intervals in a circumferential direction of the roller brush body 11 at the outer peripheral wall of the roller brush body 11. Correspondingly, avoidance openings 122 is provided and arranged at intervals in the circumferential direction of the sleeve 12 at the outer peripheral wall of the sleeve 12. As illustrated in FIG. 7, two avoidance openings 122 of an elongated shape are formed at the outer peripheral wall of the sleeve 12 and both extend spirally around the circumferential direction of the sleeve 12. In one embodiment, the two avoidance openings 122 are spaced apart from each other in a circumferential direction and evenly arranged on the sleeve 12. At the same time, two bristle portions 116 of an elongated shape are provided at the outer peripheral wall of the roller brush body 11 and spaced apart from each other in the circumferential direction evenly. The two bristle portions 116 and the two avoidance openings 122 are in one-to-one correspondence. In this way, the bristle portion 116 can be extended out of the sleeve 12 through the corresponding avoidance openings 122, cleaning the ground.

That is, by providing bristle portions 116 and avoidance openings 122, the bristles 112 always have contact points with the ground, improving stability of the cleaning. In one embodiment, during the operation of the floor brush assembly 100, when the roller brush body 11 rotates by one revolution, several cleaning is performed by bristle portions 116 at the same position, which greatly improves cleaning efficiency.

In some embodiments, a reinforcement rib 124 is provided at the avoidance opening 122. The reinforcement rib 124 has two ends respectively connected to each of two side walls of the avoidance opening 122, to divide the avoidance opening 122 into sub-openings 123 in an axial direction of the sleeve 12. The bristle portion 116 includes sub-bristle groups arranged at intervals in an axial direction of the roller brush body 11. A spacing between sub-openings 123 corresponds to the reinforcement rib 124. Sub-openings 123 and sub-bristle groups are in one-to-one correspondence.

In other words, as illustrated in FIG. 7, reinforcement ribs 124 is provided at the avoidance opening 122. Reinforcement ribs 124 has two ends respectively connected to each of the two side walls of the avoidance opening 122. An extending direction of each of reinforcement ribs 124 intersects an extending direction of the avoidance opening 122 around the sleeve 12, which enhances an overall structural strength of the sleeve 12. In one embodiment, the avoidance opening 122 is divided into sub-openings 123, and the bristle portion 116 is correspondingly provided with sub-bristle groups. Sub-bristle groups is configured to be extended out of the sleeve 12 for cleaning the ground. In one embodiment, sub-bristle groups keeps a predetermined spacing from the reinforcement ribs 124, to prevent the deformation of the bristles 112 from being interfered by the reinforcement ribs 124, which improves the dust removal capability of the bristles 112 and overall performance of the floor brush assembly 100.

In an exemplary implementation, two reinforcement ribs 124 may be provided and are spaced apart from each other in the avoidance opening 122, to divide the avoidance opening into three sub-openings 123. The bristle portion 116 is provided with three corresponding sub-bristle groups. Each of the sub-openings 123 has a length greater than a length of the corresponding sub-bristle group and a width much greater than a width of the corresponding sub-bristle group. In one embodiment, the sub-bristle group is arranged in a middle region of the sub-opening 123 to maintain a sufficient spacing from an inner peripheral wall of the sub-opening 123, providing an enough space for the deformation of the bristles 112.

It should be noted that the sub-bristle group may be configured as cluster-shaped bristles 112 arranged at equal intervals or in a connected bristle-strip form.

In some embodiments, a gap is formed between the outer peripheral wall of the roller brush body 11 and the inner peripheral wall of the sleeve 12. The gap is filled with a flexible dust removal member 115. It should be noted that during the rotation of the roller brush body 11 in the sleeve 12, the bristles 112 are continuously extended or retracted through the avoidance opening 122, and especially during the extending and retracting, an airflow with a high velocity can be easily formed within an interior space of the sleeve by a vacuum assembly of the floor brush assembly 100. As a result, the airflow generally carries a large amount of dust.

That is, a flowing channel of the airflow inside the sleeve 12 is blocked by providing the flexible dust removal member 115, which avoids disordered flow of the airflow in the sleeve 12 and guides the airflow to pass near the cleaning surface at a high velocity. In one embodiment, the dust is taken away at a high speed while the bristles 112 sweep the ground. Therefore, it is possible to improve the dust removal capability of the bristles 112 and reduce dust accumulation in the sleeve 12.

In some embodiments, the flexible dust removal member 115 is arranged at the outer peripheral wall of the roller brush body 11. Further, the flexible dust removal member 115 and the roller brush body 11 are integrally formed. The flexible dust removal member 115 extends in the radial direction of the sleeve 12 and has a radial outer side elastically abutting with the inner peripheral wall of the sleeve 12. That is, the flexible dust removal member 115 is integrated at the outer peripheral wall of the roller brush body 11, i.e., the roller brush body 11 and the flexible dust removal member 115 may be mounted in the sleeve 12 through single mounting, which simplifies mounting steps and lowers mounting cost. In addition, during the rotation of the roller brush body 11, the flexible dust removal member 115 always rotates with the roller brush body 11 to maintain to be fixed relative to the bristles 112, avoiding interference in normal operation of the bristles 112.

It can be understood that, when the flexible dust removal member 115 rotates to the upper region, a spacing between the roller brush body 11 and the inner peripheral wall of the sleeve 12 is increased, and elastic deformation of the flexible dust removal member 115 decreases. When the flexible dust removal member 115 rotates to the lower region, the spacing between the roller brush body 11 and the inner peripheral wall of the sleeve 12 is reduced, and the elastic deformation of the flexible dust removal member 115 increases. By setting a thickness of the flexible dust removal member 115 greater than or equal to a maximum spacing between the roller brush body 11 and the inner peripheral wall of the sleeve 12, a radial outer side of the flexible dust removal member 115 always elastically abuts with the inner peripheral wall of the sleeve 12, which avoids disordered movement of the airflow in the sleeve 12, reduces the dust accumulation in the sleeve 12, and improves a cleaning effect.

Figure 8:
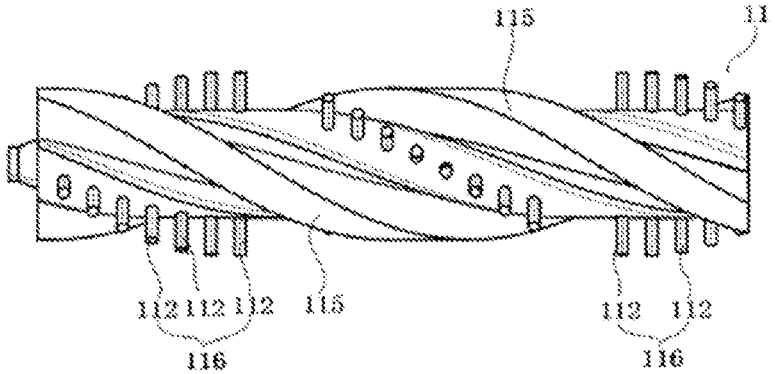
FIG. 8 is a schematic structural view of a roller brush body of a driving mechanism of a floor brush assembly according to an embodiment of the present disclosure.

In some embodiments, flexible dust removal members 115 is provided, and bristle portions 116 is provided. Flexible dust removal members 115 and bristle portions 116 are alternatively arranged in the circumferential direction of the roller brush body 11, to be arranged at the outer peripheral wall of the roller brush body 11. That is, as illustrated in FIG. 8, the flexible dust removal member 115 is constructed as a rectangular blocky structure and spirally extends in the circumferential direction of the sleeve 12. In one embodiment, a constant distance is formed between a side wall of the flexible dust removal member 115 and the bristles 112. Flexible dust removal members 115 and bristle portions 116 are alternatively arranged at the outer peripheral wall of the roller brush body 11, to separate adjacent bristle portions 116 from each other completely.

As illustrated in FIG. 8, flexible dust removal members 115 and bristle portions 116 both spirally extend in the circumferential direction of the sleeve 12 and are alternatively arranged at the outer peripheral wall of the roller brush body 11. After the roller brush body 11 is mounted at the cavity of the sleeve 12, flowing channels that is not in communication with each other is formed, and the airflow in the sleeve 12 is suitable for flowing through the flowing channel to blow the cleaning surface, carrying away the dust at a high speed while the bristles 112 sweep the ground, which increases the dust removal capability of the bristles 112 and avoids disordered flow of the airflow in the sleeve 12. In addition, the accumulation of dust in the sleeve 12 is reduced, and the cleaning effect is enhanced.

In some embodiments, the driving mechanism 2 further includes a power source 29, a transmission shaft 25, a linkage structure 26, and a driving wheel 22 connected to the power source 29. The power source 29 may be configured as a drive motor, and the driving wheel 22 may be configured as a belt pulley. Further, a drive wheel 291 is provided at a motor shaft of the drive motor. A rotation axis of the belt pulley is parallel to a rotation axis of the drive wheel 291, and the belt pulley and the drive wheel 291 are arranged to directly face towards each other radially. In this way, the drive wheel 291 is in transmission engaged with the belt pulley through a belt 3, enabling a driving force output by the drive motor to be transferred to the belt pulley through the belt 3 at the drive wheel 291 and then to be distributed towards the first driving member 23 and the second driving member 24 through the belt pulley.

The driving wheel 22 is connected to the first driving member 23 through the transmission shaft 25. As illustrated in FIG. 5, the first driving member 23 is constructed as a circular block, allowing the first driving member 23 to have its own rotation axis and to rotate around its own rotation axis. As illustrated in FIG. 5, the second driving member 24 is constructed as a circular block, allowing the second driving member 24 to have its own rotation axis and to rotate around its own rotation axis. Furthermore, as illustrated in FIG. 3, the first driving member 23 is in direct contact engagement with a right end of the roller brush body 11 and can drive the roller brush body 11 to rotate, and the second driving member 24 is in direct contact engagement with the right end of the sleeve 12 and can drive the sleeve 12 to rotate. That is, a part of a driving force from the drive motor is output to the first driving member 23 through the transmission shaft 25 at the belt pulley, allowing the roller brush body 11 to rotate in the sleeve 12. In addition, another part of the driving force is output to the second driving member 24 through the linkage structure 26, allowing the sleeve 12 to rotate relative to the housing 1001.

In some embodiments, the driving wheel 22 has a transmission hole. The driving wheel 22 may be constructed as the belt pulley. The transmission shaft 25 passes through the transmission hole and is relatively fixed to the driving wheel 22 circumferentially. The second driving member 24 has an avoidance hole 244 constructed as a circular hole. The avoidance hole 244 penetrates the second driving member 24 in a thickness direction of the second driving member 24. The transmission shaft 25 passes through the avoidance hole 244 to be connected to the first driving member 23. As illustrated in FIG. 6, the belt 3 is mounted at an outer peripheral wall of the driving wheel 22 for being in transmission engagement with the drive wheel 291 of the drive motor. In one embodiment, a first transmission hole 221 is formed at a central position of the driving wheel 22 and penetrates the driving wheel 22 in an axial direction of the driving wheel 22. An axis of the first transmission hole 221 is coincident with an axis of the belt pulley. In this way, when the belt pulley rotates, the belt pulley rotates around the axis of the first transmission hole 221. The second driving member 24 has an avoidance hole 244 and a third transmission hole 245. The avoidance hole 244 is located at a central position of the second driving member 24 and penetrates the second driving member 24 in an axial direction of the second driving member 24. An axis of the avoidance hole 244 is coincident with an axis of the second driving member 24.

Here, the transmission shaft 25 passes through the first transmission hole 221 and is relatively fixed to the driving wheel 22 circumferentially. Further, the transmission shaft 25 passes through the avoidance hole 244 to be connected to the first driving member 23. That is, the transmission shaft 25 may be circumferentially fixed to the belt pulley at the first transmission hole 221, enabling the transmission shaft 25 to be driven by the belt pulley to rotate. In an exemplary design, the first transmission hole 221 may have a polygonal surface, and the transmission shaft 25 is designed as a multi-prism structure at a position where the transmission shaft 25 is engaged with the first transmission hole 221, enabling the transmission shaft 25 to rotate under the action of an inner peripheral wall of the first transmission hole 221.

A rotation axis of the transmission shaft 25 is coincident with an axis of the driving wheel 22, a rotation axis of the second driving member 24 is coincident with the axis of the avoidance hole 244, and the axis of the driving wheel 22 is offset from the rotation axis of the second driving member 24, enabling the axis of the avoidance hole 244 to be offset from an axis of the transmission shaft 25. As illustrated in FIG. 6, the second transmission hole 222 is located at a radial outer side of the first transmission hole 221 on the belt pulley. That is, an axis of the second transmission hole 222 is offset from the rotation axis of the belt pulley. In one embodiment, the third transmission hole 245 on the second driving member 24 is located at a radial outer side of the avoidance hole 244. That is, an axis of the third transmission hole 245 is offset from the rotation axis of the second driving member 24. One end of the linkage structure 26 extends to the second transmission hole 222 to be rotatably engaged with the driving wheel 22, and another end of the linkage structure 26 extends into the third transmission hole 245 to be rotatably engaged with the second driving member 24.

In some embodiments, as illustrated in FIG. 6, a right end of the linkage structure 26 and the second transmission hole 222 are arranged to directly face towards each other in an axial direction of the belt pulley, and the right end of the linkage structure 26 may extend into the second transmission hole 222. An outer peripheral wall of the right end of the linkage structure 26 is rotatably engaged with an inner peripheral wall of the second transmission hole 222. Meanwhile, a left end of the linkage structure 26 and the third transmission hole 245 are arranged to directly face towards each other in the axial direction of the second driving member 24, and the left end of the linkage structure 26 extends into the third transmission hole 245. In one embodiment, projections of the two ends of the linkage structure 26 in the axial direction of the second driving member 24 are offset from each other. In this way, the rotation axis of the belt pulley may be offset from the rotation axis of the second driving member 24.

It should be noted that, as illustrated in FIG. 6, the avoidance hole 244 is a central hole of the second driving member 24, and the first transmission hole 221 is a central hole of the belt pulley. In one embodiment, a diameter of the avoidance hole 244 is greater than a diameter of the first transmission hole 221. In this way, when the transmission shaft 25 passes through the avoidance hole 244, the transmission shaft 25 may be constructed to allow its own axis to be offset from the axis of the avoidance hole 244, allowing the transmission shaft 25 and the second driving member 24 to be eccentrically arranged. As illustrated in FIG. 3, a left end of the transmission shaft 25 is connected to the first driving member 23, the first driving member 23 is in power connection with the right end of the roller brush body 11, and the transmission shaft 25 is located at a lower region in the avoiding hole 244, allowing a rotation axis of the first driving member 23 to deviate downwards relative to a rotation axis of a second drive shaft. In this way, during the rotation of the roller brush body 11, the bristles 112 of the roller brush body 11 can be extended from the avoidance opening 122 of the sleeve 12 at the lower part of the sleeve 12.

That is, in the present disclosure, through the design of the linkage structure 26 and the transmission shaft 25, the axis of the first transmission hole 221 is coincident with a rotation axis of the driving wheel 22, the axis of the avoidance hole 244 is coincident with the rotation axis of the second driving member 24, and an axis of the transmission shaft 25 is offset from the axis of the avoidance hole 244. In this way, in a process in which the roller brush body 11 is driven by the first driving member 23 to rotate relative to the sleeve 12, the rotation axis of the first driving member 23 is offset from the rotation axis of the second driving member 24, making the rotation axis of the sleeve 12 be offset from the rotation axis of the roller brush body 11 and realizing eccentric rotation between the roller brush body 11 and the sleeve 12.

In some embodiments, the driving mechanism 2 further includes a bearing support block 27. The bearing support block 27 is supported at the second driving member 24 and rotatable relative to the second transmission block. As illustrated in FIG. 3, the second driving member 24 includes a transmission portion 241 and a support connection portion 242. The transmission shaft 25 penetrates the support connection portion 242 and the transmission portion 241 sequentially. The third transmission hole 245 is formed at the support connection portion 242 and is open towards a side facing away from the transmission portion 241 to be connected and engaged with the second linkage structure 26.

Here, the transmission portion 241 has a radial dimension greater than a radial dimension of the support connection portion 242. A middle part of the transmission portion 241 is open towards the roller brush body 11 to form a middle mounting space. The avoidance hole 244 is formed at the support connection portion 242 and penetrates the transmission portion 241 to the middle mounting space of the transmission portion 241. A radial dimension of the middle mounting space is greater than a radial dimension of the avoidance hole 244. As illustrated in FIG. 3, the bearing 4 is mounted in the middle mounting space, and the bearing support block 27 is rotatably supported in the middle mounting space through the bearing 4, enabling the bearing support block 27 to be rotatable in the second driving member 24.

The bearing support block 27 has an eccentric hole 271. The eccentric hole 271 may be constructed as a circular hole and penetrates the bearing support block 27 in a thickness direction of the bearing support block 27. The axis of the avoidance hole 244 is offset from an axis of the eccentric hole 271. In this way, the axis of the eccentric hole 271 is offset from the axis of the avoidance hole 244, and an outer peripheral wall of the transmission shaft 25 is engaged with an inner peripheral wall of the eccentric hole 271 through the bearing 4, enabling the transmission shaft 25 to be rotatable relative to the bearing support block 27. As illustrated in FIG. 6, the bearing support block 27 is a circular block, and the eccentric hole 271 is arranged at a lower part of the bearing support block 27, i.e., the axis of the eccentric hole 271 is lower than an axis of the bearing support block 27. Therefore, the transmission shaft 25 can be rotatably supported at a lower part of the bearing support block 27 through the bearing 4.

It should be noted that the bearing support block 27 is mounted at a lower part in the second driving member 24, and is simultaneously rotatably engaged with the second driving member 24 and the transmission shaft 25 through the bearing 4. In this way, during actual operation, the second driving member 24 may be driven by the belt pulley through the linkage structure 26 to rotate relative to the bearing support block 27, to drive the sleeve 12 to rotate. Meanwhile, the first driving member 23 may be driven by the belt pulley through the transmission shaft 25 to rotate relative to the bearing support block 27, to drive the roller brush body 11 to rotate. Therefore, the eccentric rotation of the roller brush body 11 relative to the sleeve 12 can be achieved.

That is, in the present disclosure, through the design of the bearing support block 27, the first driving member 23 and the second driving member 24 may be reasonably and eccentrically mounted. Meanwhile, reasonably eccentrical rotation of the first driving member 23 and the second driving member 24 may be realized through an engagement between the linkage structure 26 and the transmission shaft 25. In this way, the roller brush body 11 and the sleeve 12 can be rotatably driven by the same belt pulley in two different paths, respectively. Therefore, during the operation of the floor brush assembly 100, the bristles 112 can be effectively extended out of or retracted into the sleeve 12, which realizes the cleaning of the ground and removal of the elongated objects on the bristles 112. In one embodiment, reasonability of the structural design and the practicability of the floor brush assembly 100 can be improved.

According to embodiments of the present disclosure, a vacuum cleaner 1000 is also provided.

In the vacuum cleaner 1000 according to an embodiment of the present disclosure, the floor brush assembly 100 for the vacuum cleaner according to any one of the above embodiments is provided, and the first driving member 23 and the second driving member 24 are eccentrically arranged to allow the bristles 112 to be selectively extended out of or retracted into the sleeve 12, which can solve a problem in which the roller brush body 11 becomes tangled with elongated objects such as hair and threads. In addition, the bristle portion 116 and the avoidance opening 122 are both of the elongated shape and arranged to directly face towards each other in the radial direction of the roller brush body 11. Therefore, when the bristle portion 116 is extended out of the sleeve 12 through the avoidance opening 122, the influence of the inner wall of the avoidance opening 122 on the bristles 112 is reduced, which provides the bristles 112 with the large extended space and enhances the dust removal capability of the bristles 112. Meanwhile, the bristle portion 116 and the avoidance opening 122 of the elongated shape have the low assembly difficulty, which improves the mounting efficiency of the roller brush body 11 and the sleeve 12 and the overall performance of the floor brush assembly 100.

Other arrangements and operations of the vacuum cleaner according to the embodiments of the present disclosure are known, and the description thereof in detail will be omitted herein.

In the description of the present disclosure, it is to be understood that, terms such as "center", "length", "width", "thickness", "over", "below", "front", "back", "left", "right", "vertical", "horizontal", "top", "bottom", "in", "out", "axial", "radial", "circumferential", etc., is based on the orientation or position relationship shown in the drawings, and is only for the convenience of describing the present disclosure and simplifying the description, rather than indicating or implying that the pointed device or element must have a specific orientation, or be constructed and operated in a specific orientation, and therefore cannot be understood as a limitation of the present disclosure.

In addition, the terms "first" and "second" are only used for descriptive purposes, and cannot be understood as indicating or implying relative importance or implicitly indicating the number of indicated features. Therefore, the features associated with "first" and "second" may explicitly or implicitly include at least one of the features. In the description of the present disclosure, "plurality" means at least two, unless otherwise specifically defined.

In the present disclosure, unless otherwise clearly specified and limited, terms such as "install," "connect," "connect to," "fix" and the like should be understood in a broad sense. For example, it may be a fixed connection or a detachable connection or connection as one piece; mechanical connection or electrical connection or communication; direct connection or indirect connection through an intermediate; internal communication of two components or the interaction relationship between two components. The specific meaning of the above-mentioned terms in the present disclosure can be understood according to specific circumstances.

In the description of this specification, descriptions with reference to the terms "an embodiment," "some embodiments," "examples," "specific examples," or "some examples" etc., mean that specific features, structure, materials or characteristics described in conjunction with the embodiment or example are included in at least one embodiment or example of the present disclosure. In this specification, the schematic representations of the above terms do not necessarily refer to the same embodiment or example. In one embodiment, the described specific features, structures, materials or characteristics may be combined in any one or more embodiments or examples in a suitable manner. In addition, combination of the different embodiments or examples and the features of the different embodiments or examples described in this specification without contradicting each other.

What is claimed is:

1. A floor brush assembly for a vacuum cleaner, the floor brush assembly comprising:

a roller brush component, the roller brush component comprising a sleeve and a roller brush body rotatably mounted in the sleeve, the roller brush body being provided with bristles arranged in an elongated shape to form a bristle portion, the sleeve having an avoidance opening of an elongated shape, and the bristle portion and the avoidance opening being arranged to directly face towards each other in a radial direction of the roller brush body; and a driving mechanism, the driving mechanism comprising a first driving member and a second driving member, the first driving member being configured to drive the roller brush body to rotate, the second driving member being configured to drive the sleeve to rotate, and the first driving member and the second driving member being eccentrically arranged to allow the bristle portion to be selectively extended or retracted through the avoidance opening, wherein the driving mechanism further comprises a power source, a driving wheel connected to the power source, a transmission shaft, and a linkage structure, the driving wheel being connected to the first driving member through the transmission shaft and connected to the second driving member through the linkage structure.

2. The floor brush assembly according to claim 1, wherein the avoidance opening extends spirally in a circumferential direction of the sleeve, and the bristle portion is constructed to follow a shape of the avoidance opening.

3. The floor brush assembly according to claim 2, wherein:

a plurality of bristle portions is provided and arranged at intervals in a circumferential direction of the roller brush body; and a plurality of avoidance openings is provided and arranged at intervals in the circumferential direction of the sleeve, the plurality of bristle portions and the plurality of avoidance openings being in one-to-one correspondence.

4. The floor brush assembly for the vacuum cleaner according to claim 2, wherein:

a reinforcement rib is provided at the avoidance opening and divides the avoidance opening into a plurality of sub-openings in an axial direction of the sleeve; and the bristle portion comprises a plurality of sub-bristle groups arranged at intervals in an axial direction of the roller brush body, the plurality of sub-openings and the plurality of sub-bristle groups being in one-to-one correspondence.

5. The floor brush assembly according to claim 1, wherein a flexible dust removal member is provided between an outer peripheral wall of the roller brush body and an inner peripheral wall of the sleeve.

6. The floor brush assembly according to claim 5, wherein the flexible dust removal member is integrated at the outer peripheral wall of the roller brush body, and wherein a radial outer side of the flexible dust removal member elastically abuts with the inner peripheral wall of the sleeve.

7. The floor brush assembly according to claim 5, wherein:

a plurality of flexible dust removal members is provided; and a plurality of bristle portions is provided, the plurality of flexible dust removal members and the plurality of bristle portions being alternatively arranged at the outer peripheral wall of the roller brush body.

8. The floor brush assembly according to claim 1, wherein:

the driving wheel has a transmission hole, the transmission shaft passing through the transmission hole and being relatively fixed to the driving wheel circumferentially;

the second driving member has an avoidance hole, the transmission shaft passing through the avoidance hole to be connected to the first driving member;

a rotation axis of the driving wheel is coincident with an axis of the transmission shaft;

an axis of the avoidance hole is coincident with a rotation axis of the second driving member; and the axis of the transmission shaft is offset from the axis of the avoidance hole.

9. The floor brush assembly according to claim 8, wherein the driving mechanism further comprises a bearing support block rotatably supported at a second transmission block, the bearing support block having an eccentric hole, an axis of the eccentric hole being offset from the axis of the avoidance hole, and the transmission shaft being rotatably supported at the eccentric hole.

10. A vacuum cleaner, comprising:

a floor brush assembly comprising:

a roller brush component, the roller brush component comprising a sleeve and a roller brush body rotatably mounted in the sleeve, the roller brush body being provided with bristles arranged in an elongated shape to form a bristle portion, the sleeve having an avoidance opening of an elongated shape, and the bristle portion and the avoidance opening being arranged to directly face towards each other in a radial direction of the roller brush body; and a driving mechanism, the driving mechanism comprising a first driving member and a second driving member, the first driving member being configured to drive the roller brush body to rotate, the second driving member being configured to drive the sleeve to rotate, and the first driving member and the second driving member being eccentrically arranged to allow the bristle portion to be selectively extended or retracted through the avoidance opening, wherein the driving mechanism further comprises a power source, a driving wheel connected to the power source, a transmission shaft, and a linkage structure, the driving wheel being connected to the first driving member through the transmission shaft and connected to the second driving member through the linkage structure.

11. The vacuum cleaner according to claim 10, wherein the avoidance opening extends spirally in a circumferential direction of the sleeve, and the bristle portion is constructed to follow a shape of the avoidance opening.

12. The vacuum cleaner according to claim 11, wherein:

a plurality of bristle portions is provided and arranged at intervals in a circumferential direction of the roller brush body; and a plurality of avoidance openings is provided and arranged at intervals in the circumferential direction of the sleeve, the plurality of bristle portions and the plurality of avoidance openings being in one-to-one correspondence.

13. The vacuum cleaner for the vacuum cleaner according to claim 11, wherein:

a reinforcement rib is provided at the avoidance opening and divides the avoidance opening into a plurality of sub-openings in an axial direction of the sleeve; and the bristle portion comprises a plurality of sub-bristle groups arranged at intervals in an axial direction of the roller brush body, the plurality of sub-openings and the plurality of sub-bristle groups being in one-to-one correspondence.

14. The vacuum cleaner according to claim 10, wherein a flexible dust removal member is provided between an outer peripheral wall of the roller brush body and an inner peripheral wall of the sleeve.

15. The vacuum cleaner according to claim 14, wherein the flexible dust removal member is integrated at the outer peripheral wall of the roller brush body, and wherein a radial outer side of the flexible dust removal member elastically abuts with the inner peripheral wall of the sleeve.

16. The vacuum cleaner according to claim 14, wherein:

a plurality of flexible dust removal members is provided; and a plurality of bristle portions is provided, the plurality of flexible dust removal members and the plurality of bristle portions being alternatively arranged at the outer peripheral wall of the roller brush body.

17. The vacuum cleaner according to claim 10, wherein:

the driving wheel has a transmission hole, the transmission shaft passing through the transmission hole and being relatively fixed to the driving wheel circumferentially;

the second driving member has an avoidance hole, the transmission shaft passing through the avoidance hole to be connected to the first driving member;

a rotation axis of the driving wheel is coincident with an axis of the transmission shaft;

an axis of the avoidance hole is coincident with a rotation axis of the second driving member; and the axis of the transmission shaft is offset from the axis of the avoidance hole.

18. The vacuum cleaner according to claim 17, wherein the driving mechanism further comprises a bearing support block rotatably supported at a second transmission block, the bearing support block having an eccentric hole, an axis of the eccentric hole being offset from the axis of the avoidance hole, and the transmission shaft being rotatably supported at the eccentric hole.

* * * * *